US005145424A

United States Patent [19]

Han

[11] Patent Number: 5,145,424

[45] Date of Patent: Sep. 8, 1992

[54] HUMAN-POWERED BOAT PROPELLING EQUIPMENTS

[76] Inventor: Sihui Han, 3800 Pepperell Pkwy., Opelika, Ala. 36801

[21] Appl. No.: 747,721

[22] Filed: Aug. 19, 1991

[51] Int. Cl.[5] ..... B63H 16/18

[52] U.S. Cl. ..... 440/13; 105/88; 280/253; 440/21

[58] Field of Search ..... 440/13, 17, 21, 22, 440/24, 26, 31, 25; 280/252, 253, 258, 244; 105/88, 94

[56] References Cited

U.S. PATENT DOCUMENTS

| | | | |
|---|---|---|---|
| 558,615 | 4/1896 | Saladee | 105/88 |
| 693,615 | 2/1902 | Minkus | 440/24 |
| 1,137,604 | 4/1915 | Greene | 105/94 |
| 4,936,802 | 6/1990 | Ueno | 440/21 X |

FOREIGN PATENT DOCUMENTS

| | | | |
|---|---|---|---|
| 406903 | 12/1924 | Fed. Rep. of Germany | 440/24 |

*Primary Examiner*—Sherman Basinger

[57] ABSTRACT

A human-powered boat propelling drive is provided for translating occupant's body weight and variable movements into the power for propelling boat. By coupling the propelling drives, a human-powered boat propelling device is provided which can be propelled and steered by occupant's body weight and movements. By grouping the propelling drives and devices on series or on parallel or mixed parallel series, variable human-powered boat propelling systems can then be provided for a wide range of boat applications.

5 Claims, 2 Drawing Sheets

HUMAN-POWERED BOAT PROPELLING EQUIPMENTS

FIELD OF THE INVENTION

This invention relates to boat propelling equipments, particularly to human-powered boat propelling equipments for a wide range of boats which can be used for propelling the boats by occupant's body weight and variable movements.

BACKGROUND OF THE INVENTION

The most popular boat which can be run by human power is the boat in which an oar is pulled by occupant's hands. The boat with such a human-powered propelling oar has some propulsion efficiency but both hands have to be occupied pulling the oar, and the occupant's body weight is not used for propelling the boat. Therefore, the boat with the propelling oar is limited in the occupant's operation position and movement and the efficiency is not good enough.

Various different forms of human-powered boat propulsion equipments without the propelling oar heretofore have been provided. Almost all the foot-operated boat propelling equipments are pedal cycling drives, such as those disclosed in U.S. Pat. Nos. 650,224, 1,462,027, 1,471,747, 2,664,064, 2,703,065, 3,211,125, 4,891,024, and 4,960,396. However, all the propelling devices have the problems in that the construction thereof is complicated and voluminous, and that they could not make good use of occupant's body weight for propelling the boat. U.S. Pat. No. 4,936,802 shows a "Swing and Propelling ship", by using a wing-like fin. However, the propulsive efficiency is poor and the operator become easily tired.

SUMMARY OF THE INVENTION

Accordingly, it is highly desirable to provide human-powered boat propulsion equipments which can eliminate all the above mentioned disadvantages.

Objects and advantages of the present invention are:

(a) to provide human-powered boat propelling equipments which can make good use of the occupant's body weight and generate good propulsion to allow the occupant(s) to move the boat faster and easier, (b) to provide human-powered boat propulsion equipments which are active for human body variable operations, (c) to provide human-powered boat propulsion equipments which should be not only usable, but also simple and inexpensive for manufacturing an also small and light to be portable for practical use, (d) to provide human-powered boat propulsion equipments which can used on a wide range of boats, (e) to provide human-powered boat propulsion equipments which can be easily installed on the boats and operated by not only just one but also two or more occupants simultaneously.

(f) to provide human-powered boat propelling equipments which can be used not only for propelling but also for steering the boat.

A specific object and advantage of the invention is to provide human-powered boat with the propelling equipments which give the occupant(s) a forward movement as like skating on the wave of the water.

Other objects and advantages of the invention will become apparent through consideration of the drawings, description and claims thereof.

The present invention provide first a preferred embodiment of human-powered propelling drive, a human-powered propelling device is then provided by coupling the propelling drive, and a human-powered propelling system is then provided by using the propelling drives and devices on series or parallel for variable types of boats.

The propelling drive which presents an essential component of the invention comprises basically a platform and a gear train having plural gear drives for transmitting occupant's energy into a force enabling boat to move, plural transmission shafts for connecting the gears, and at least one gear box for fixing the gear train and shafts. The gear train includes a gear sector, plural transmission spur gears and two bevel gears which are connected with two one-way clutches and a output bevel gear. The output bevel gear is connected with a screw-type propeller which enables boat to move.

DESCRIPTION OF THE INVENTION

The Propelling Drive

Figure 2:
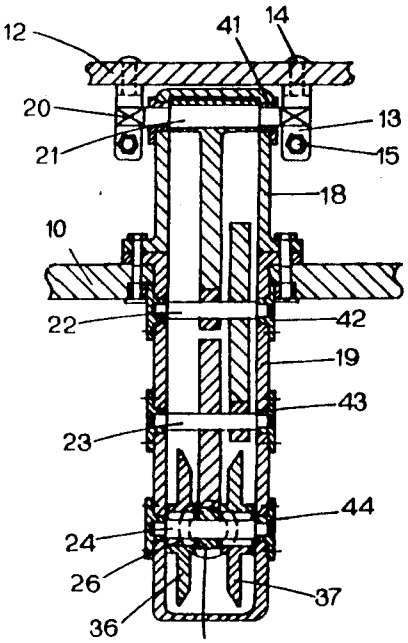
FIG. 2 is a front side sectional view of the human-powered propelling drive.
Figure 1:
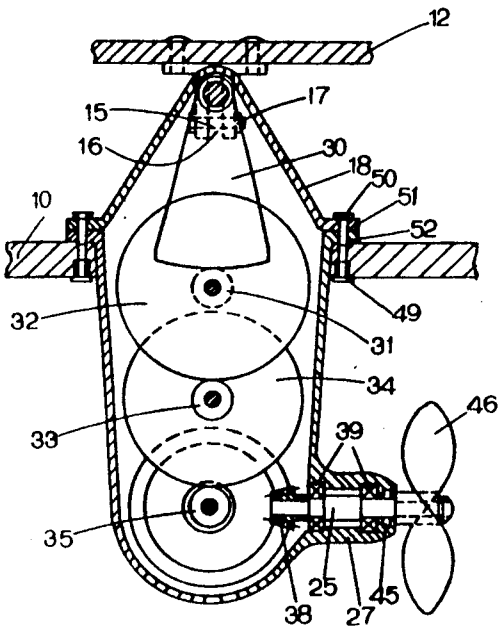
FIG. 1 is a left side sectional view of the human-powered propelling drive.

A preferred embodiment of the human-powered boat propelling drive is shown in FIG. 1 for a left side sectional view and in FIG. 2 for a front side sectional view of the propelling drive.

The propelling drive consists of a platform for occupant's supporting and operating, a gear train for power transmission and increasing speeds, plural gear shafts, a gear box for fixing the propelling drive and a screw-type propeller for enabling the boat to move forward.

The platform consists of a board 12 which is for occupant's supporting and operating and two hangers 13. Each hanger 13 is fixed on the bottom side of the board 12 with bolts 14. On the bottom side of the hanger 13, there is a square slot 16 which meshes the square head 20 of the input shaft 21 of the gear train. A bolt 15 and a nut 17 are used to tight the hanger 13 on the shaft 21 at each end of the shaft 21.

The gear train comprises a gear sector 30, five transmission gears 31, 32, 33, 34, 35 and three bevel gears 36, 37, 38. The gear sector 30 meshes with the small gear 31 which is fixedly mounted with the bigger gear 32. The gear sector 30 is pivotally mounted on the shaft 21 which is pivotally mounted on the gear box cover 18 through two flanges 41 and fixed with the hangers 13 at the both ends of the shaft 21. The gears 31 and 32 are connected with a gear shaft 22 which is mounted on the gear train box 19 with two flanges 42 at both ends of the shaft 22. The gear 32 meshes with the small gear 33 which is fixedly mounted with the bigger gear 34. The gears 33 and 34 are connected with a gear shaft 23 with is mounted on the gear box 19 with two flanges 43 at both ends of the shaft 23. The gear 34 meshes with the small gear 35 which is connected with the gear shaft 24. The shaft 24 is pivotally mounted in the gear box 19 with two flanges at both sides of the shaft 24. On both sides of the small gear 35, two bevel gears 36 and 37 are mounted on the shaft 24 through roller clutches 26 The two bevel gears 36 and 37 mesh with the small bevel gear 38 which is fixedly mounted on the shaft 25. The shaft 25 is pivotally mounted in the protrude cylinder part 27 of the gear box 19 with two bearings 39 and a sealing washer 45. On the another end of the shaft 25, a screw-type propeller 46 is fixedly mounted through a propeller fixture 47 and a locknut 48.

Figure 3:
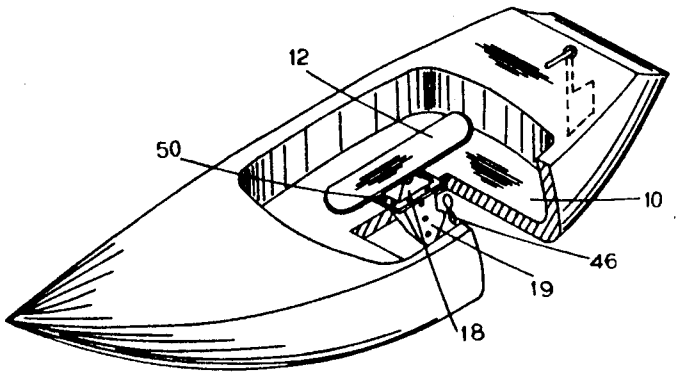
FIG. 3 is a partially cutaway perspective view showing the human-powered propelling drive for a lightweight boat.
Figure 4:
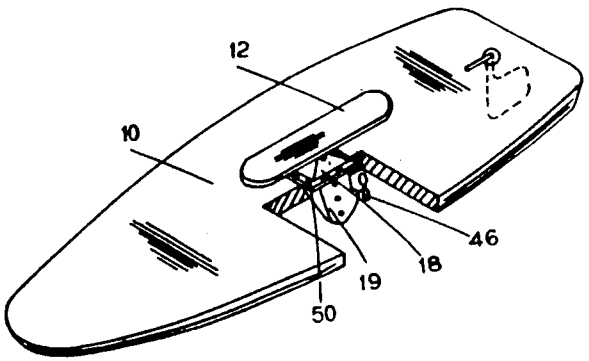
FIG. 4 is a partially cutaway perspective view showing the human-powered propelling drive for a watercraft like boat.

FIGS. 3 and 4, show applications of the preferred embodiment of the propelling drive in a lightweight boat and a watercraft like boat respectively. The propelling drive is fixed with bolts in middle of the boat through a small oblong hole which size is same as the connecting portion of the transmission gear box 19.

The Propelling Device

Figure 5:
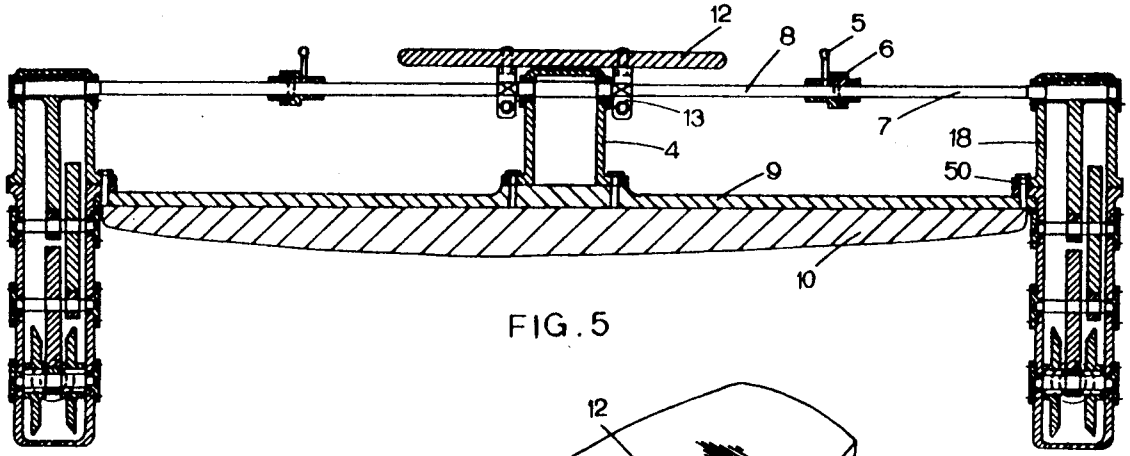
FIG. 5 is a front side sectional view of the human-powered propelling device.

A preferred embodiment of the human-powered boat propelling device is shown in FIG. 5 for a front side sectional view of the propelling device.

The differences of the preferred embodiment of the propelling device from the preferred embodiment of the propelling drive consist of:

(a) the coupling of the preferred embodiment of the propelling drives, (b) the addition of the necessary fixture for connecting the coupling propelling drives with the platform, (c) the addition of two shaft clutches for steering.

As shown in FIG. 5, two propelling drives are used at both sides of the boat. A base 9 connects the both propelling drives and a platform support 4 which is similar to the gear box cover 18 for supporting the platform. The board 12 and the two hangers 13 are fixed with a platform shaft 8 which is pivotally mounted on the support 4. At each end of the shaft 8, an on-line coupling-slip clutch is used for connecting platform shaft 8 and input shaft 7 of the gear transmission box. A handbar 5 is fixed on the slip clutch 6 for steering operation.

Figure 6:
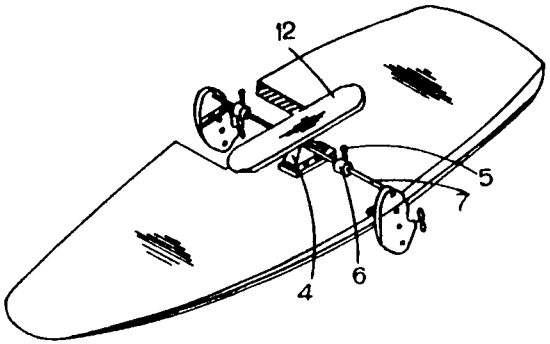
FIG. 6 is a partially cutaway perspective view showing the human-powered propelling device for a watercraft like boat.

FIG. 6 show an application of the propelling device in a watercraft like boat.

The Propelling Systems

The propelling drives and devices can be grouped in as many ways as people want. A propelling system can be readily constructed by combining the propelling drives or devices on series or on parallel or mixed parallel-series for a wide rang of boat applications.

Figure 8:
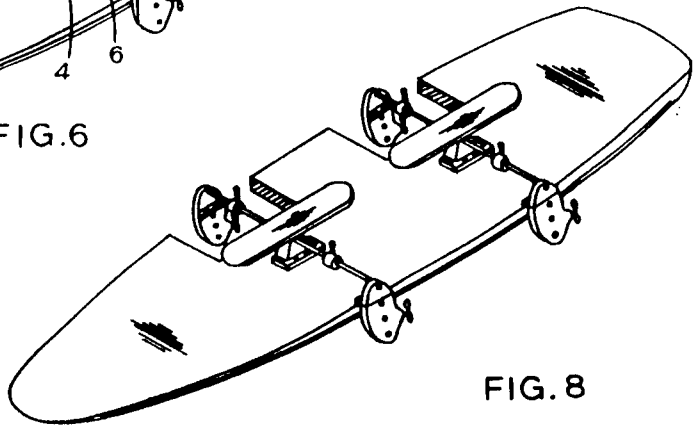
FIG. 8 is a partially cutaway perspective view illustrating a propelling system comprising two human-powered propelling devices on series for a watercraft like boat.
Figure 7:
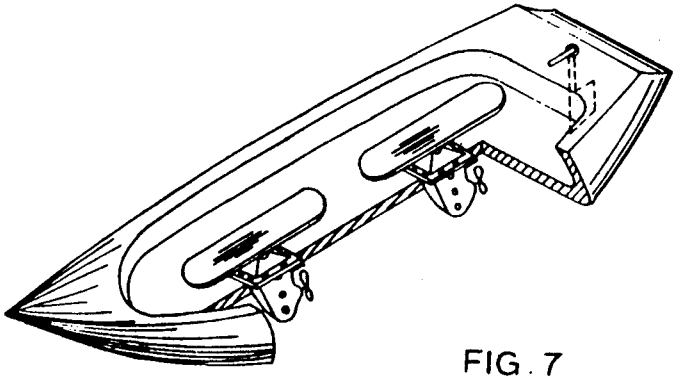
FIG. 7 is a partially cutaway perspective view illustrating a propelling system comprising two human-powered propelling drives on series for a boat.

Cite instances in illustration of the propelling systems: FIG. 7 shows a propelling system comprising two propelling drives on series in a boat, and FIG. 8 shows a propelling system comprising two propelling devices on series in a watercraft like boat.

Operation of the Propelling Drive

While coasting, an occupant is normally standing with one foot on the front of the board 12 and the other foot on the rear of the board 12. During the occupant's pedalling, the board 12 would then be alternatively depressed and returned, which applies alternatively a propelling leverage through the hangers 13 to the gear sector 30. The force is then transmitted alternatively through the gear train to the bevel gears 36 and 37, and then through the one-way clutch to rotate the propeller 46 which enables boat to move. The two one-way clutches 24 in the bevel gears 36 and 37 convert the reciprocating rotational movement, transmitted by the spur gear train, into rotational movement always in a single direction. As the propelling device has high enough gear drive ratio, a small foot movement would produce significant speeds under the action of the occupant's body weight and movement so as to allow the occupant to move the boat faster and easier.

The boat with the propelling drive can be not only propelled by the occupant's pedalling, but also by the occupant's other body movements, such as jumping, bouncing, shaking, waving, wagging, balancing, swing and so on, provided that the movement can give a relative rotation between the gear sector 30 and the gear train. Accordingly, the propelling drive make good use of human body weight and movements so that the occupant of the boat can have more choices for operation means and have more opportunities for long-duration use, performance and speeding.

Operation of the Propelling Device and Systems

FIG. 6 shows applications of the propelling device in a watercraft like boat. The whole propelling device is just put on the hull 10 of a watercraft without having to make any hole for fixing the device and readily movable whenever if it is needed.

While coasting, the occupant is pedalling on the board 12, which applies alternatively a propelling leverage to the gear sector 30 at each side of the board 12 through the hanger 13, the platform shaft 8, the slip clutch 6 and the input shaft 7. The force is then transmitted through the gear train and the bevel gears with the one-way clutches to rotate the propeller to move the boat forward.

When it is needed to make a turn or steering, the boat occupant just handle one of the slip clutches 6 at the both sides of the operating board 12. As example, when the left side of the slip clutch is disconnected with the input shaft 7 of the gear transmission, the left side of the propeller 46 is not running and just the right propeller rotates so that the boat steers to left.

The operation of the propelling systems which are combinations of the propelling drives or/and devices is identical to that of the propelling drive or/and device.

CONCLUSION AND SCOPE

The above description of the invention provide novel means of non-motorized boat propelling equipments, which provide for a wide range of boats, a better means for water entertainment, convenience or performance.

It is to be understood that the present invention is by no means limited to the specific showing in the drawings and description of the preferred embodiments of the invention, but also encompasses any exemplifications of several of their possible forms within the scope of the invention. Following then, are some examples of possible variations on the invention:

(a) The number of the transmission gears as well as shafts could be different to have different gear train ratio and different size of the gear box for different applications of the invention.

(b) The operating board could be different to have not only one but also two or two more occupants simultaneously operating on the propelling equipments.

(c) A handle-bar and a chair can be added on the boat or on the operating board so that the boat can be propelled just by the occupant's body swinging movement.

(d) The propelling equipments can be applied on a wide range of heretofore known boats, such as fishing boat, watercraft, sailboard, canoe, kayak, ski-boat, fun-boat, race-boat and other inflatable boats for water entertainment, convenience or performance.

What is claimed is:

1. A human-powered propelling drive for propelling a boat, said human-powered propelling drive comprising:

a platform for supporting an occupant and for operation by the occupant, said platform including a board, said board having a bottom side, two hangers fixed to said bottom side, said hangers each having a square slot, an input gear shaft, said input gear shaft having two end sections, each of said end sections having a square head, each said square head being received in an associated one of said square slots;

a support for said platform;

a first gear train for power transmission and increasing drive ratio, said gear train comprising a first gear sector, a first transmission gear shaft, a first transmission gear mounted on said first gear shaft, a second transmission gear shaft, a second transmission gear mounted on said second gear shaft, a bevel gear shaft, at least one bevel gear mounted on said bevel gear shaft, a first one-way clutch, said first one-way clutch connected to said at least one bevel gear, and a second bevel gear;

an output shaft, said output shaft having a free end, a plurality of bearings, said bearings rotatably supporting said output shaft, and a propeller fixed upon said free end of said output shaft;

a gear box, said gear box rotatably supporting said first gear shaft, said second gear shaft, said bevel gear shaft, said plurality of bearings, and said output shaft;

wherein said board drives said propeller through said gear sector, said first gear shaft, said first transmission gear, said second gear shaft, said second transmission gear, said bevel gear shaft, said one-way clutch, said at least one bevel gear, said second bevel gear, and said output shaft so as to propel said boat.

2. A drive as set forth in claim 1 wherein said platform support comprises a gear box cover, said gear box cover rotatably supporting said input gear shaft and said first gear sector.

3. A drive as set forth in claim 1 wherein a third bevel gear and a second one-way clutch are mounted on said bevel gear shaft.

4. A drive as set forth in claim 1 further comprising a second gear train, a second output shaft, and a second propeller, said board driving said second propeller through said second gear train and said second output shaft.

5. A drive as set forth in claim 4 wherein said second gear train includes a second gear sector, said input gear shaft being connected with said first gear sector by a first on-line coupling slip clutch and connected with said second gear sector by a second on-line coupling slip clutch, said first slip clutch and said second slip clutch allowing steering of said boat by disconnecting one of said first slip clutch and said second slip clutch.

* * * * *